United States Patent [19]
Dantzig et al.
[11] 4,317,679
[45] * Mar. 2, 1982

[54] METHOD AND APPARATUS FOR THE DEGASSING OF MOLTEN METAL

[75] Inventors: Jonathan A. Dantzig, New Haven; Derek E. Tyler, Cheshire, both of Conn.

[73] Assignee: Swiss Aluminium Ltd., Chippis, Switzerland

[ * ] Notice: The portion of the term of this patent subsequent to Nov. 25, 1997, has been disclaimed.

[21] Appl. No.: 139,782

[22] Filed: Apr. 14, 1980

Related U.S. Application Data

[63] Continuation of Ser. No. 41,787, May 23, 1979, Pat. No. 4,235,627, which is a continuation-in-part of Ser. No. 865,895, Dec. 30, 1977, abandoned.

[51] Int. Cl.[3] ..... C21C 7/00

[52] U.S. Cl. ..... 75/93 E; 75/68 R; 266/217

[58] Field of Search ..... 266/217; 75/93 RE, 68 R

[56] References Cited

U.S. PATENT DOCUMENTS

| | | | |
|---|---|---|---|
| 23,123 | 3/1859 | Stewart et al. | 266/217 |
| 3,490,897 | 1/1970 | Dore et al. | 75/93 |
| 4,235,627 | 11/1980 | Dantzig et al. | 75/68 R |

*Primary Examiner*—M. J. Andrews
*Attorney, Agent, or Firm*—Bachman & LaPointe

[57] ABSTRACT

An improved method and apparatus for degassing molten metal is disclosed in which the molten metal is passed in countercurrent relationship with a fluxing gas which is introduced through a sparger plate provided with a plurality of orifices of controlled size and spacing so as to minimize fluxing gas bubble size while maximizing fluxing gas bubble density thereby optimizing the degassing of the molten metal.

3 Claims, 4 Drawing Figures

THEORETICAL DIMENSIONLESS AVERAGE CONCENTRATION VS. DIMENSIONLESS TIME FOR $\beta = 0.50$ AND SEVERAL VALUES OF $N_D$

METHOD AND APPARATUS FOR THE DEGASSING OF MOLTEN METAL

CROSS REFERENCE TO RELATED APPLICATION

The present application is a continuation of copending application Ser. No. 041,787, filed May 23, 1979, now U.S. Pat. No. 4,235,627 which in turn is a continuation-in-part of application Ser. No. 865,895, filed Dec. 30, 1977, now abandoned.

BACKGROUND OF THE INVENTION

The present invention relates to the degassing of molten metal. Molten metal, particularly molten aluminum in practice, generally contains entrained and dissolved impurities both gaseous and solid which are deleterious to the final cast product. These impurities may affect the final cast product after the molten metal is solidified whereby processing may be hampered or the final product may be less ductile or have poor finishing and anodizing characteristics. The impurities may originate from several sources. For example, the impurities may include metallic impurities such as alkaline and alkaline earth metals and dissolved hydrogen gas and occluded surface oxide films which have become broken up and are entrained in the molten metal. In addition, inclusions may originate as insoluble impurities such as carbides, borides and others or eroded furnace and trough refractories.

One process for removing gaseous impurities from molten metals is by degassing. The physical process involves injecting a fluxing gas into the melt. The hydrogen enters the purge gas bubbles by diffusing through the melt to the bubble where it adheres to the bubble surface and is adsorbed into the bubble itself. The hydrogen is then carried out of the melt by the bubble.

It is naturally highly desirable to improve the degassing of molten metals in order to remove or minimize such impurities in the final cast product, particularly in aluminum and especially, for example, when the resultant metal is to be used in a decorative product such as a decorative trim or products bearing critical specifications such as aircraft forgings and extrusions and light gauge foil stock. Impurities as aforesaid cause loss of properties such as tensile strength and corrosion resistance in the final cast product.

Rigorous metal treatment processes such as gas fluxing or melt filtration have minimized the occurrence of such defects. However, while such treatments have generally been successful in reducing the occurrence of such defects to satisfactory levels, they have been found to be inefficient and/or uneconomical. Conventionally conducted gas fluxing processes such as general hearth fluxing have involved the introduction of the fluxing gas to a holding furnace containing a quantity of molten metal. This procedure requires that the molten metal be held in the furnace for significant time while the fluxing gas is passed through so that the metal being treated would remain constant and treatment could take place. This procedure has many drawbacks, among them, the reduced efficiency and increased cost resulting from the prolonged idleness of the furnace during the fluxing operation and more importantly, the lack of efficiency of the fluxing operation due to poor coverage of the molten metal by the fluxing gas which is attributable to the large bubble size and poor bubble dispersion within the melt. Further factors comprise the restriction of location to the furnace which permits the re-entry of impurities to the melt before casting, and the high emissions resulting from both the sheer quantity of fluxing gas required and the location of its circulation.

As an alternative to the batch-type fluxing operations employed as aforesaid, certain fluxing operations were employed in an inline manner; that is, the operation and associated apparatus were located outside the melting or holding furnace and often between the melting furnace and either the holding furnace or the holding furnace and the casting station. This helped to alleviate the inefficiency and high cost resulting from furnace idleness when batch fluxing but was not successful in improving the efficiency of the degassing operation itself, in that the large size of the units and the undesirably large quantities of fluxing gas required per unit of molten metal were both costly and detrimental to air purity.

A typical inline gas fluxing technique is disclosed in U.S. Pat. No. 3,737,304. In the aforenoted patent, a bed of "stones" is positioned in a housing through which the molten metal will pass. A fluxing gas is introduced beneath the bed and flows up through the spaces between the stones in counter flow relationship with the molten metal. The use of a bed of porous "stones" has an inherent disadvantage. The fact that the stones have their pores so close together results in the bubble passing through the stones coalescing on their surface and thus creating a relatively small number of large bubbles rather than a large number of small bubbles. The net effect of the bubbles coalescing is to reduce the surface area of bubble onto which the hydrogen can be adsorbed thus resulting in low degassing efficiency.

Accordingly, it is a principal object of the present invention to provide an improved method and apparatus for the degassing of molten metal.

It is a particular object of the present invention to provide an improved method for controlling the introduction and dispersion of fine fluxing gas bubbles into a molten metal.

It is still a further principal object of the present invention to provide an improved apparatus for controlling the size and dispersion of a fluxing gas.

Further objects and advantages of the present invention will be evident from what appears hereinbelow.

SUMMARY OF THE INVENTION

In accordance with the present invention, the foregoing objects and advantages are readily attained.

The present invention comprises a highly efficient degassing apparatus comprising a chamber having respective metal inlets and outlets, side walls and a floor. The chamber is divided by a baffle into two parts. Molten metal is caused to flow from the inlet to the first part of the chamber under the baffle to the second part of the chamber and out the respective outlet. A sparger plate is provided in the floor of the chamber to introduce a fluxing gas into the molten metal as it passes through the first part of the chamber prior to passing under the baffle into the second part of the chamber. In the preferred embodiment, the sparger plate is designed in such a manner as to maximize the surface area and dispersion of the degassing bubbles for the adsorption of gaseous impurities. The sparger plate provides a plurality of orifices for introducing the fluxing gas into the molten metal. The orifice size and the mean distance between the orifices should be controlled so as to minimize the diffusion distance for the gaseous impurities while being sufficiently large to prevent bubble coalescence.

In accordance with the method of the present invention, degassing of molten metal is conducted by passing the molten metal through a chamber wherein the metal is brought into countercurrent contact with a fluxing gas while within a first part of the chamber, said fluxing gas, having issued from a sparger plate located within the first part of said chamber, percolates up into contact with the molten metal within the first part of the chamber. The method and apparatus of the present invention allows for the efficient treatment of commercial metal flow rates which are typical for DC casting.

The method of the present invention may employ a fluxing gas such as an inert gas, preferably carrying a small quantity of an active gaseous ingredient such as chlorine or a fully halogenated carbon compound. The gas used may be any of the gases or mixtures of gases such as nitrogen, argon, chlorine, carbon monoxide, Freon 12, etc., that are known to give acceptable degassing. In the preferred embodiment for the degassing of molten aluminum melts, mixtures of nitrogen-Freon 12 or argon-Freon 12 are preferred. In addition, a supernatant salt cover comprised of alkaline and alkaline earth chlorides and a fluoride may be located on the surface of the melt to aid in the degassing process by minimizing the readsorption of gaseous impurities at the surface of the melt. Typical salts employed may be molten halides such as sodium chloride, potassium chloride, magnesium chloride, or mixtures thereof and should be selected to minimize erosion of the refractory lining of the degassing chamber. Alternatively, gaseous covers such as argon, nitrogen, etc., may be used as a protective cover over the molten metal to minimize the readsorption of gaseous impurities at the surface of the melt.

The apparatus and method of the present invention provides a considerable improvement in the degassing of molten metal by optimizing the efficiency of the adsorption of the gaseous impurities.

The employment of the sparger plate of the present invention in the above apparatus minimizes the bubble size of the purged gas while maximizing the gas bubble density thereby increasing the effective surface area for carrying out the adsorption reaction thus optimizing the degassing of the motlen metal.

In addition, the efficiency of the present invention permits degassing to be conducted with a sufficiently lower amount of flux material whereby the level of effluence resulting from the fluxing operation is greatly reduced.

DETAILED DESCRIPTION

Figure 1:
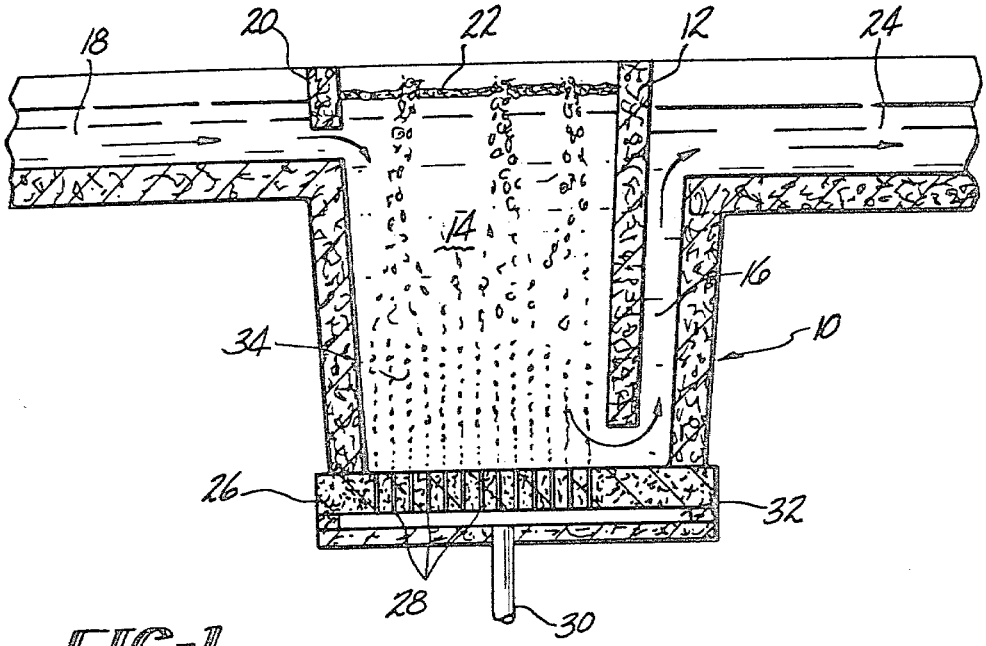
FIG. 1 is a schematic sectional view of the apparatus of the present invention used for degassing molten metal.

Referring to FIG. 1, the apparatus is illustrated in location with a molten metal transfer system which may include pouring pans, pouring troughs, transfer troughs, filtering troughs, metal treatment bays or the like. The apparatus and method of the present invention may be employed in a wide variety of locations occuring intermediate the melting and casting stations in the metal processing system. Thus, FIG. 1 illustrates a refractory fluxing box 10 which is divided by a baffle wall 12 into chambers 14 and 16. The molten metal enters chamber 14 through inlet launder 18 under a second baffle 20 which serves to confine a molten salt layer 22 on the surface of the metal in chamber 14 and prevent it from flowing backwards along the launder 18. The molten metal passes through chamber 14 under baffle 12 into chamber 16 and down outlet launder 24 for further processing.

In accordance with the present invention, the floor of the fluxing box consists of a cast ceramic sparger plate 26 having a plurality of orifices 28 for introducing a fluxing gas from the inlet 30 and plenum chamber 32 into the molten metal as it passes through chamber 14.

Figure 2:
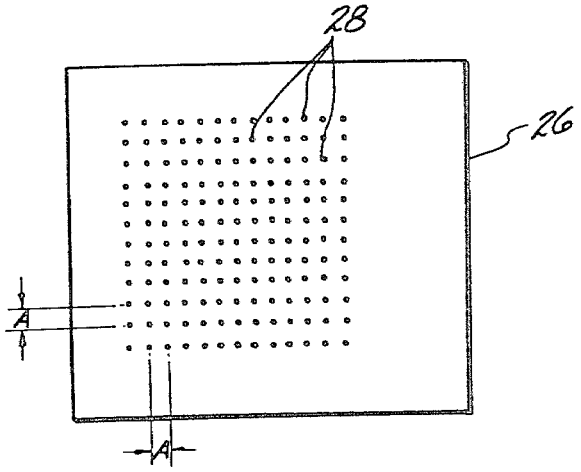
FIG. 2 is a top view of the sparger plate employed in the apparatus of FIG. 1.

In the preferred embodiment of the present invention, the use of a cast ceramic sparger plate has a distinct advantage over conventional methods and apparatuses for introducing fluxing gas into a molten melt. In accordance with the present invention, in order to optimize the efficiency of the degassing process; that is, maximize the efficiencies of the kinetics of the adsorption reaction, the introduction of the fluxing gas into the melt should be optimized so as to provide minimum bubble size and maximum bubble density while eliminating bubble coalescence. Thus, the mean distance between the orifices in the sparger plate should be controlled so as to prevent fluxing gas bubble coalescence while minimizing the diffusion distance which the gaseous impurities must travel through the melt to a bubble. Maximum adsorption efficiency is obtained by employing a sparger plate as illustrated in FIG. 2. The use of discrete orifices 28 in the sparger plate avoids bubble coalescence and allows for control of the bubble size and dispersion. The size of the individual orifices 28 determines the size of the bubble. Accordingly, in order to maximize surface area for the adsorption reaction, the orifices are made as small as possible consistent with preventing plugging of the orifices with metal over several uses. In accordance with the present invention, an orifice size in the range of 0.005" to 0.050", preferably 0.010" to 0.020" has been utilized for degassing molten aluminum and aluminum alloys. The inter-orifice spacing, A, as illustrated in FIG. 2, is critical for providing maximum dispersion of bubbles while maintaining sufficient distance between the bubbles so as to prevent bubble coalescence. Inter-orifice spacings in the range of 0.25" to 5.00", preferably 0.75" to 2.00" have been found optimum when degassing molten aluminum and its alloys.

The fluxing gas which may be employed in the present apparatus and method comprises a wide variety of well known components including chlorine gas and other halogenated gaseous material, carbon monoxide as well as certain inert gas mixtures derived from and including nitrogen, argon, helium and the like. A preferred gas mixture for use in the present invention for degassing molten aluminum and aluminum alloys comprises a mixture of nitrogen or argon with dichlorodifluoromethane from about 2 to about 20% by volume, preferably 5 to 15% by volume. In conjunction with this gas mixture, a molten salt mixture 22 may be employed on the surface of the melt residing within chamber 14 which would comprise halides such as sodium chloride, potassium chloride, magnesium chloride or mixtures thereof. It should be noted that the molten salt mixture should be selected to minimize erosion of the refractory lining of the fluxing box. In addition, a gaseous protective cover of argon, nitrogen or the like may be used over the molten metal so as to minimize readsorption of gaseous impurities at the surface of the melt in the same manner as the molten salt. The above noted and foregoing compositions are presented for purposes of illustration only and do not form a material limitation on the present invention.

Referring to FIG. 1, molten metal is delivered to the refractory box 10 which is divided into chambers 14 and 16 by a baffle wall 12. The molten metal is introduced into chamber 14 by an inlet launder 18 under baffle wall 20. As the molten metal passes through chamber 14 under baffle wall 12 into chamber 16, the molten metal is brought into countercurrent flow with a fluxing gas, depicted as a plurality of bubbles 34, which is introduced into chamber 14 via gas inlet 13, plenum chamber 32 and a plurality of orifices 28 in cast ceramic sparger plate 26. A molten salt cover 22 may be provided on the surface of the melt as previously noted so as to minimize the readsorption of gaseous impurities into the melt. As the fluxing gas passes through the melt in countercurrent flow with the melt, the gaseous impurities diffuse through the melt, adhere to the fluxing gas bubble, is adsorbed into the bubble itself and is subsequently carried up to the surface as the bubble percolates up through the melt thereby removing said impurities.

The particular optimum dimension of the sparger plate, orifice size and orifice spacing is dependent on a number of parameters. These parameters include metal flow rate, box dimension, desired final hydrogen concentration, fluxing gas and volume of fluxing gas employed. The fluxing box volume is determined by what is available within the particular plan. The metal flow rate is selected so as to be commensurate with commercial DC practices for the particular box volume. The procedure for determining the optimum sparger plate dimensions will be made clear from a consideration of the following example which is illustrative of the present invention.

Initially, one selects the desired fluxing box volume, the desired metal flow rate and the desired hydrogen ending concentration. For example:

$C_o$=0.4 cc/100 g $C_f$=0.10 cc/100 g

Metal flow rate=5.8 lb/sec

Box dimension=14"×14"×16"=3136 in$^3$ where $C_o$ is initial concentration and $C_f$ is the desirable final concentration. One can calculate the bubble size from the equation $$d_b = 0.015\,\theta\left(\frac{2\sigma}{g(\rho_{liq}-\rho_{gas})}\right)^{\frac{1}{2}}$$

where $\theta$=contact angle of the bubble on the sparger plate=120°

Figure 3:
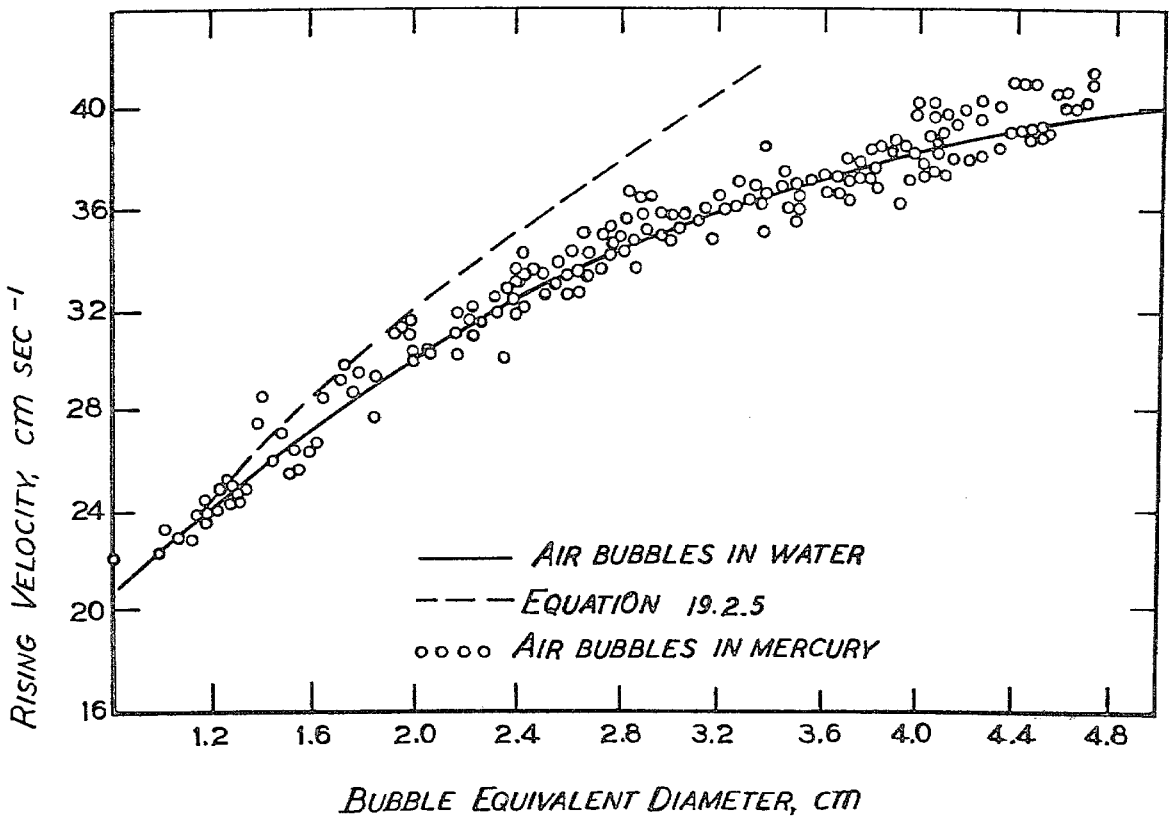
FIG. 3 is a graph illustrating the relationship between bubble diameter and bubble rising velocity.

$\sigma$=surface tension=700 dyne/cm g=gravity=980 cm/sec$^2$ $\rho$liq=density of liquid (here aluminum)=2.37 g/cm$^3$ $\rho$gas=density of fluxing gas (here $N_2$-5% Freon)=0.001 g/cm$^3$ so that $d_b$=1.4 cm Referring to FIG. 3, knowing the $d_b$ one can obtain the rising velocity of the gas bubble. For example, for $d_b$=1.4 cm $U_b$=bubble rising velocity=25 cm/s Maximum degassing efficiency is achieved when bubble dispersion is optimized therefore one selects a hole spacing S which is as small as possible but not smaller than 2 $d_b$ so as to prevent coalescence, for example where $d_b$=1.4 cm $S_{min}$=2 (1.4 cm)=2.8 cm The total number of holes in the sparger plate can be calculated from the equation $$\text{number of holes} = \left(\frac{\text{Box length}}{S}\right)^2$$

where

Box length=(14 in) (2.54 cm/in)

S=2.8 cm so that number of holes=160

From experimental data the kinetic rate constant, k, for the fluxing gas is determined, for example for $N_2$-5% Freon k=0.5 cm/sec/(cc/100 g)

and for $N_2$ k=0.08 cm/sec/(cc/100 g)

One can now use the above data to compute the various process parameters. For example, processing time, t, from the equation $$\text{Process Time} = t = \frac{\text{Average treatment time}}{\text{Characteristic diffusion time}} = \frac{\text{Box Volume/Metal Flow Rate}}{S^2/4 \times \text{Diffusion Constant}}$$

where

Box volume=3136 in$^3$×0.087 lb/in$^3$

Metal flow rate=5.8 lb/sec

S=2.8

Diffusion constant for hydrogen in Aluminum=0.1 cm$^2$/sec so that t=2.4 geometry parameter, $\beta$, from the equation $$\text{Geometry Parameter} = \beta = \frac{\text{bubble diameter}}{\text{hole spacing}} = \frac{d_b}{S}$$

where $d_b$=1.4 cm

S=2.8 cm so that $\beta$=0.5 and efficiency parameter, C, from the equation $$\text{Efficiency Parameter} = C = \frac{C_{final} - C_{eq}}{C_o - C_{eq}} \quad (\text{for Al } C_{eq} \sim 0.05 \text{ cc/100g})$$

where $C_f$=0.10 cc/100 g $C_o$=0.4 cc/100 g $C_{eq}$ for aluminum=0.05 cc/100 g so that

C=0.14

Figure 4:
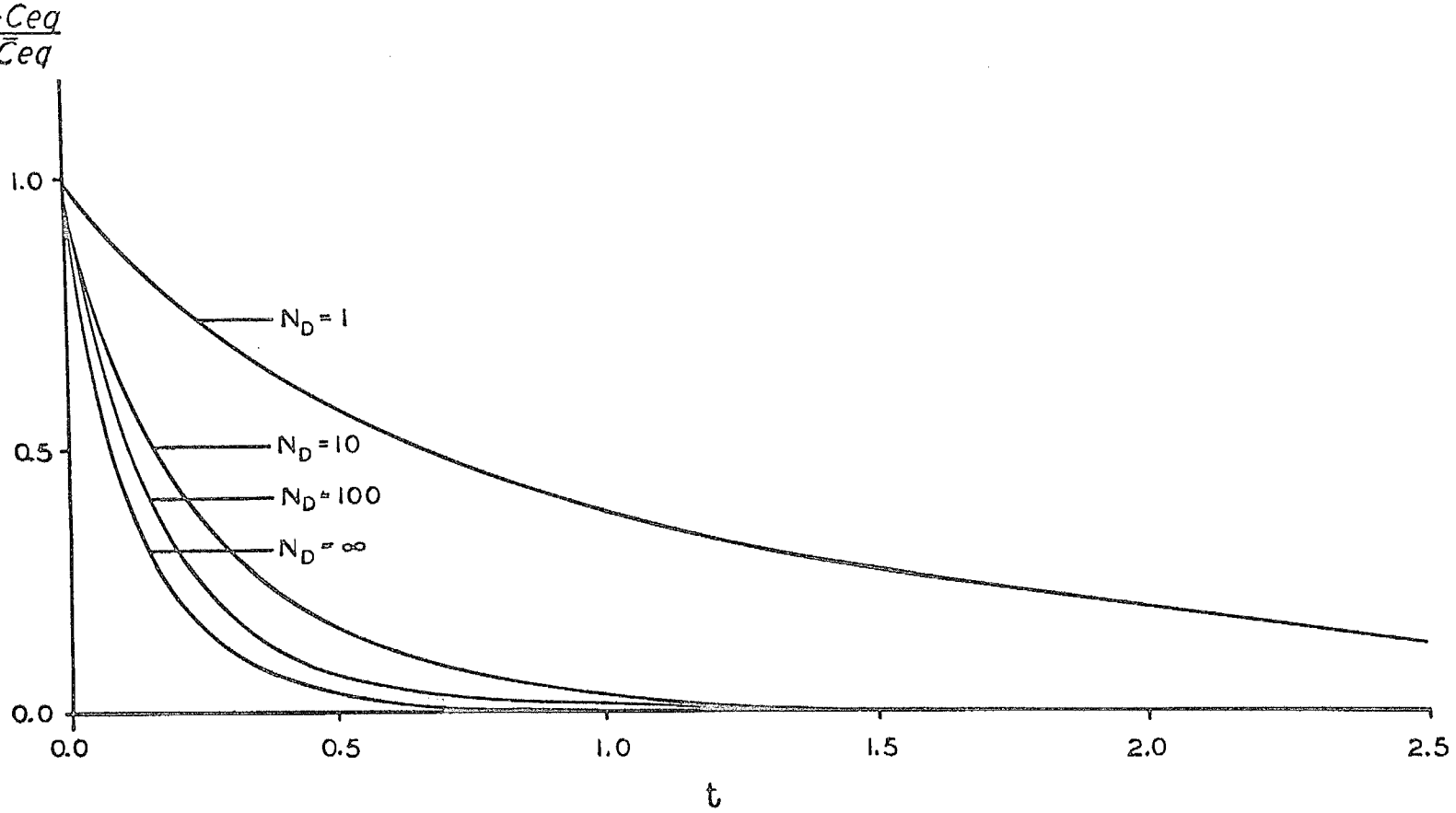
FIG. 4 is a graph illustrating the relationship between concentration and time of treatment.

Referring to FIG. 4 which is generated for experimental data, one can determine the proper unit number, $N_D$, which is required to get the desired C of 0.14 for the given t of 2.4, for this example from $\beta=0.5$ $N_D \geqq 1$ The flow rate per hole, F, can now be computed from the equation $$F = \frac{\pi\beta N_D D d_b U_b}{6kC_o}$$

where $\beta=0.5$ $N_D=1.0$

D=diffusion constant=0.1 $cm^2/sec$ $d_b=1.4$ cm $U_b=25$ cm/sec k=0.5 cm/sec/(cc/100 gr)

$C_o=0.4$ cc/100 gr so that

F=4.58 $cm^3/sec$

To compute the orifice size limits, for quiescent flow through the orifice the Reynolds number, $N_{Re}$, must be less than 500. Thus, one limit of the orifice size, $d_o$, is determined from the equation $$N_{Re} = \frac{4F}{\pi d_o \nu} < 500$$

which when solving for $d_o$ gives $$d_o > \frac{4F}{500\pi\nu} = \frac{(4)(4.58\ cm^3/sec)}{(500)(\pi)(0.73\ cm^2/sec)} = 0.016\ cm$$

where $N_{Re}<500$

F=4.58 $cm^3/sec$ $\nu$=kinematic viscosity=0.73 $cm^2/sec$ so that $d_o>0.016$ cm.

In order to control the process, the pressure drop across the sparger plate should be at least 15 psi. Thus, the upper limit of the orifice size, $d_o$, can be obtained from the equation $$\Delta P = \rho F L \nu \frac{128}{\pi d_o^4}$$

which when solving for $d_o$ gives $$d_o \leqq \left(\rho F L \nu \frac{128}{\pi \Delta P}\right)^{\frac{1}{4}}$$

where $\rho=0.001$ $g/cm^3$

F=4.58 $cm^3/sec$

L=thickness of sparger plate=5 cm $\nu=0.73$ $cm^2/sec$ $\Delta P$ = total of the pressure drop across the holes =

-continued $$\frac{160\ \text{holes}}{(15\ \text{psi})\left(\frac{68947\ g/cm/sec^2}{cm^2/psi}\right)}$$

so that $d_o \leqq 0.10$ cm

Thus, for this example, the hole size in the sparger plate is restricted to 0.016 cm$<d_o\leqq$0.10 cm. The sparger plate comprises 160 holes spaced a distance A as shown in FIG. 2 of 2.8 cm. The gas flow rate is to be 4.6 $cm^3$/sec/hole or a total of about 45 l/min of $N_2$-5% Freon.

A fluxing box similar to that illustrated in FIG. 1 with internal dimensions of 14"×14" and 16" high was located in an existing molten metal transfer system. A melt of molten aluminum was passed through the fluxing box at a flow rate of 350 pounds per minute or 5.8 lbs per second. The sparger plate in the floor of the fluxing box contained 160 orifices of 0.040 cm in diameter uniformly distributed over the area of the sparger plate at an interorifice spacing of 2.8 cm. A fluxing gas of a mixture of 5% by volume dichlorodifluoromethane in nitrogen was introduced into the chamber at a flow rate of 45 liters per minute so as to flow in a countercurrent relation with the molten aluminum. It was found that the hydrogen content of the molten metal was reduced from 0.4 cc/100 gm before the unit to 0.1 cc/100 gm after the degassing treatment thereby representing an extremely efficient method of degassing.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for degassing molten metal by purging said molten metal with a fluxing gas which comprises a fluxing box having a floor, inlet means for delivering said molten metal to said fluxing box, outlet means for removing said molten metal from said fluxing box, the improvement which comprises means located within said fluxing box for purging said molten metal with said fluxing gas while said molten metal is within said fluxing box, said means comprising a sparger plate means being provided with an array of orifices of controlled size and spacing wherein said orifice size is in the range of 0.005" to 0.050" and said orifice spacing is in the range of 0.25" to 5.00" so as to minimize fluxing gas bubble size while maximizing fluxing gas bubble dispersion thereby optimizing the degassing of said molten metal.

2. An apparatus according to claim 1 wherein said sparger plate means constitutes the floor of said fluxing box.

3. A method for degassing molten metal by purging said molten metal with a fluxing gas which comprises passing said fluxing gas through said molten metal in counter-current flow therewith, the improvement comprising feeding said fluxing gas to said molten metal through a sparger plate characterized by having an array of discrete orifices of controlled size and spacing wherein said orifice size is in the range of 0.005" to 0.050" and said orifice spacing is in the range of 0.25" to 5.00" so as to minimize fluxing gas bubble size while maximizing fluxing gas bubble dispersion thereby optimizing the degassing of said molten metal.

* * * * *